US011263980B2

(12) United States Patent
Park et al.

(10) Patent No.: US 11,263,980 B2
(45) Date of Patent: Mar. 1, 2022

(54) DISPLAY APPARATUS AND METHOD OF DRIVING DISPLAY PANEL USING THE SAME

(71) Applicant: Samsung Display Co., Ltd., Yongin-si (KR)

(72) Inventors: Sehyuk Park, Seongnam-si (KR); Hyojin Lee, Yongin-si (KR); Jinyoung Roh, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/669,521

(22) Filed: Oct. 31, 2019

(65) Prior Publication Data

US 2020/0193916 A1 Jun. 18, 2020

(30) Foreign Application Priority Data

Dec. 18, 2018 (KR) ..... 10-2018-0164615

(51) Int. Cl.
*G09G 3/3291* (2016.01)

(52) U.S. Cl.
CPC ..... *G09G 3/3291* (2013.01); *G09G 2310/027* (2013.01); *G09G 2320/0233* (2013.01); *G09G 2320/062* (2013.01); *G09G 2354/00* (2013.01)

(58) Field of Classification Search
CPC .. G09G 3/3258; G09G 3/3266; G09G 3/3291; G09G 2300/08; G09G 2330/021; G09G 2300/0426; G09G 2320/0247; G09G 2300/0861; G09G 2300/0819; G09G 2310/0262; G09G 2300/0842; G09G 3/3233; G09G 2340/0435
See application file for complete search history.

(56) References Cited

U.S. PATENT DOCUMENTS 9,530,380 B2 12/2016 Jang et al.
9,583,036 B2 * 2/2017 Lee ..... G09G 5/18
9,607,562 B2 3/2017 Kim et al.
(Continued)

FOREIGN PATENT DOCUMENTS

KR 10-2014-0126149 10/2014
KR 10-2015-0094881 8/2015
(Continued)

*Primary Examiner* — Carolyn R Edwards
(74) *Attorney, Agent, or Firm* — H.C. Park & Associates, PLC

(57) ABSTRACT

A display apparatus including a display panel, a gate driver, a data driver, an emission driver, and a driving controller. The display panel includes a pixel including a switching element of a first type and a switching element of a second type. The driving controller determines a driving frequency of the switching element of the first type to be a first driving frequency and a driving frequency of the switching element of the second type to be a second driving frequency less than the first driving frequency in a low frequency driving mode. The driving controller determines the second driving frequency based on a difference of a luminance of a writing frame in which the data voltage is written in the pixel and a luminance of a holding frame in which the written data voltage in the pixel is maintained without writing the data voltage.

16 Claims, 16 Drawing Sheets
(4 of 16 Drawing Sheet(s) Filed in Color)

(56) References Cited

U.S. PATENT DOCUMENTS

| | | | | |
|---|---|---|---|---|
| 10,181,293 | B2 | 1/2019 | Na et al. | |
| 2004/0196239 | A1* | 10/2004 | Kwon | G09G 3/325 345/92 |
| 2016/0035260 | A1* | 2/2016 | Kim | G09G 3/3614 345/212 |
| 2016/0321991 | A1* | 11/2016 | Song | H01L 27/3272 |
| 2017/0069273 | A1* | 3/2017 | Park | G09G 3/3233 |
| 2017/0365213 | A1* | 12/2017 | Rieutort-Louis | G09G 3/3233 |
| 2017/0365214 | A1* | 12/2017 | Tsai | G09G 3/3233 |
| 2017/0371462 | A1* | 12/2017 | Kim | G06F 3/0447 |
| 2018/0075808 | A1* | 3/2018 | Yamashita | G09G 3/3266 |
| 2018/0075809 | A1* | 3/2018 | Chang | G09G 3/3266 |
| 2018/0190197 | A1* | 7/2018 | Chang | G09G 3/3233 |
| 2018/0293939 | A1* | 10/2018 | Kim | H01L 51/5203 |
| 2019/0318692 | A1* | 10/2019 | Jiang | G09G 3/3233 |
| 2020/0082768 | A1* | 3/2020 | Oh | G09G 3/3291 |
| 2020/0243014 | A1* | 7/2020 | Zhu | G09G 3/3258 |
| 2020/0286417 | A1* | 9/2020 | Chae | G09G 3/20 |

FOREIGN PATENT DOCUMENTS

| | | |
|---|---|---|
| KR | 10-2016-0015451 | 2/2016 |
| KR | 10-2017-0010175 | 1/2017 |

* cited by examiner

FIG. 12

| GRAYSCALE VALUE | FLICKER LUT | DRIVING FREQUENCY |
|---|---|---|
| 0 | 0 | 1Hz |
| 1 | 0 | 1Hz |
| 2 | 0 | 1Hz |
| ... | ... | ... |
| 15 | 1 | 30Hz |
| 16 | 1 | 30Hz |
| 17 | 1 | 30Hz |
| 18 | 2 | 10Hz |
| 19 | 2 | 10Hz |
| 20 | 2 | 10Hz |
| 21 | 2 | 10Hz |
| 22 | 2 | 10Hz |
| 23 | 3 | 5Hz |
| 24 | 3 | 5Hz |
| 25 | 3 | 5Hz |
| 26 | 3 | 5Hz |
| 27 | 3 | 5Hz |
| ... | ... | ... |
| 254 | 0 | 1Hz |
| 255 | 0 | 1Hz |

| | | | | |
|---|---|---|---|---|
| SEG11 | SEG21 | SEG31 | SEG14 | SEG15 |
| SEG12 | SEG22 | SEG32 | SEG24 | SEG25 |
| SEG13 | SEG23 | SEG33 | SEG34 | SEG35 |
| SEG14 | SEG24 | SEG34 | SEG44 | SEG45 |
| SEG15 | SEG25 | SEG35 | SEG45 | SEG55 |

FIG. 15

| GRAYSCALE VALUE | FLICKER LUT | DRIVING FREQUENCY |
|---|---|---|
| 0-2 | 0 | 1Hz |
| 3-5 | 0 | 1Hz |
| ... | ... | ... |
| 15-17 | 1 | 30Hz |
| 18-20 | 2 | 10Hz |
| 21-23 | 2 | 10Hz |
| 24-26 | 3 | 5Hz |
| ... | ... | ... |
| 252-255 | 0 | 1Hz |

DISPLAY APPARATUS AND METHOD OF DRIVING DISPLAY PANEL USING THE SAME

CROSS REFERENCE TO RELATED APPLICATION

This application claims priority from and the benefit of Korean Patent Application No. 10-2018-0164615, filed on Dec. 18, 2018, which is hereby incorporated by reference for all purposes as if fully set forth herein.

BACKGROUND

Field

Exemplary embodiments of the present invention relate generally to a display apparatus and a method of driving a display panel using the display apparatus. More particularly, exemplary embodiments of the present invention relate to a display apparatus having reduced power consumption and enhanced display quality, and a method of driving a display panel using the display apparatus.

Discussion of the Background

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver, and a driving controller. The gate driver outputs gate signals to the gate lines. The data driver outputs data voltages to the data lines. The emission driver outputs emission signals to the emission lines. The driving controller controls the gate driver, the data driver and the emission driver.

When an image displayed on the display panel is a static image or the display panel is operated in "always on" mode, a driving frequency of the display panel may be decreased to reduce power consumption.

When the driving frequency of the display panel is decreased, a flicker may be visible to a user due to a leakage current or a luminance difference between a writing frame and a holding frame.

The above information disclosed in this Background section is only for understanding of the background of the inventive concepts, and, therefore, it may contain information that does not constitute prior art.

SUMMARY

Exemplary embodiments of the present invention provide a display apparatus capable of reducing power consumption and enhancing display quality.

Exemplary embodiments of the present invention also provide a method of driving a display panel using the display apparatus.

Additional features of the present invention will be set forth in the description which follows, and in part will be apparent from the description, or may be learned by practice of the inventive concepts.

An exemplary embodiment of the present invention provides a display apparatus including a display panel, a gate driver, a data driver, an emission driver and a driving controller. The display panel includes a pixel including a switching element of a first type and a switching element of a second type different from the first type. The gate driver is configured to output a gate signal to the display panel. The data driver is configured to output a data voltage to the display panel. The emission driver is configured to output an emission signal to the display panel. The driving controller is configured to determine a driving frequency of the switching element of the first type to be a first driving frequency and a driving frequency of the switching element of the second type to be a second driving frequency less than the first driving frequency in a low frequency driving mode. The driving controller is configured to determine the second driving frequency based on a difference of a luminance of a writing frame in which the data voltage is written in the pixel and a luminance of a holding frame in which the written data voltage in the pixel is maintained without writing the data voltage.

The driving controller may be configured to determine the driving frequency of the switching element of the first type to be the first driving frequency and the driving frequency of the switching element of the second type to be the first driving frequency in a normal driving mode.

The driving controller may be configured to determine the second driving frequency by determining a difference of the luminance of the writing frame and the luminance of the holding frame according to a grayscale value of an input image in candidate driving frequencies.

The driving controller may be configured to extract a luminance profile of the holding frame and a luminance of the writing frame and to accumulate the luminance profile of the holding frame and the luminance of the writing frame to determine the difference of the luminance of the writing frame and the luminance of the holding frame.

The driving controller may be configured to determine a minimum driving frequency in a condition that the difference of the luminance of the writing frame and the luminance of the holding frame does not exceed a "just noticeable difference" as the second driving frequency among the candidate driving frequencies.

The "just noticeable difference" may be adjusted by a user.

The display panel may include a plurality of segments. The driving controller may be configured to determine the difference of the luminance of the writing frame and the luminance of the holding frame according to the grayscale value of the input image in the candidate driving frequencies in each of the segments. The driving controller may be configured to determine optimal driving frequencies for the segments and to determine a maximum driving frequency among the optimal driving frequencies for the segments as the second driving frequency.

The driving controller may be configured to map a grayscale group including a plurality of grayscale values to the second driving frequency.

The switching element of the first type may be a polysilicon thin film transistor. The switching element of the second type may be an oxide thin film transistor.

The switching element of the first type may be a P-type transistor. The switching element of the second type may be an N-type transistor.

The pixel may include a first pixel switching element including a control electrode connected to a first node, an input electrode connected to a second node and an output electrode connected to a third node, a second pixel switching element including a control electrode to which a first data write gate signal is applied, an input electrode to which the data voltage is applied and an output electrode connected to the second node, a third pixel switching element including a control electrode to which a second data write gate signal is applied, an input electrode connected to the first node and an output electrode connected to the third node, a fourth pixel switching element including a control electrode to which a data initialization gate signal is applied, an input electrode to which an initialization voltage is applied and an output electrode connected to the first node, a fifth pixel switching element including a control electrode to which the emission signal is applied, an input electrode to which a high power voltage is applied and an output electrode connected to the second node, a sixth pixel switching element including a control electrode to which the emission signal is applied, an input electrode connected to the third node and an output electrode connected to an anode electrode of an organic light emitting element, a seventh pixel switching element including a control electrode to which an organic light emitting element initialization gate signal is applied, an input electrode to which the initialization voltage is applied and an output electrode connected to the anode electrode of the organic light emitting element, a storage capacitor including a first electrode to which the high power voltage is applied and a second electrode connected to the first node and the organic light emitting element including the anode electrode connected to the output electrode of the sixth switching element and a cathode electrode to which a low power voltage is applied.

The first pixel switching element, the second pixel switching element, the fifth pixel switching element, and the sixth pixel switching element may be polysilicon thin film transistors. The third pixel switching element, the fourth pixel switching element, and the seventh pixel switching element may be oxide thin film transistors.

The first pixel switching element, the second pixel switching element, the fifth pixel switching element, the sixth pixel switching element, and the seventh pixel switching element may be polysilicon thin film transistors. The third pixel switching element and the fourth pixel switching element may be oxide thin film transistors.

Another exemplary embodiment of the present invention provides a method of driving a display panel, the method including determining a driving frequency of a switching element of a first type to a first driving frequency in a low frequency driving mode, determining a driving frequency of a switching element of a second type different from the first type to a second driving frequency less than the first driving frequency in the low frequency driving mode, outputting a gate signal to the display panel comprising a pixel including the switching element of the first type and the switching element of the second type, outputting a data voltage to the display panel and outputting an emission signal to the display panel. The second driving frequency is determined based on a difference of a luminance of a writing frame in which the data voltage is written in the pixel and a luminance of a holding frame in which the written data voltage in the pixel is maintained without writing the data voltage.

The method may further include determining the driving frequency of the switching element of the first type to be the first driving frequency in a normal driving mode and determining the driving frequency of the switching element of the second type to be the first driving frequency in the normal driving mode.

The determining of the driving frequency to be the second driving frequency may include determining a difference of the luminance of the writing frame and the luminance of the holding frame according to a grayscale value of an input image in candidate driving frequencies.

The determining of the driving frequency to be the second driving frequency may further include extracting a luminance profile of the holding frame, extracting a luminance profile of the writing frame, accumulating the luminance profile of the holding frame, accumulation the luminance profile of the writing frame and determining the difference of the luminance of the writing frame and the luminance of the holding frame.

The determining of the driving frequency to be the second driving frequency may further include determining a minimum driving frequency in a condition that the difference of the luminance of the writing frame and the luminance of the holding frame does not exceed a "just noticeable difference" as the second driving frequency among the candidate driving frequencies.

The "just noticeable difference" may be adjusted by a user.

The display panel may include a plurality of segments. The determining of the driving frequency to be the second driving frequency may further include determining the difference of the luminance of the writing frame and the luminance of the holding frame according to the grayscale value of the input image in the candidate driving frequencies in each of the segments, determining optimal driving frequencies for the segments, and determining a maximum driving frequency among the optimal driving frequencies for the segments as the second driving frequency.

It is to be understood that both the foregoing general description and the following detailed description are exemplary and explanatory and are intended to provide further explanation of the invention as claimed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are included to provide a further understanding of the invention and are incorporated in and constitute a part of this specification, illustrate exemplary embodiments of the invention, and together with the description serve to explain the inventive concepts.

FIG. 12 is a table illustrating an exemplary flicker lookup table of FIG. 11.

FIG. 15 is a table illustrating an exemplary flicker lookup table of a driving controller of a display apparatus according to an exemplary embodiment of the present invention.

DETAILED DESCRIPTION

Figure 1:
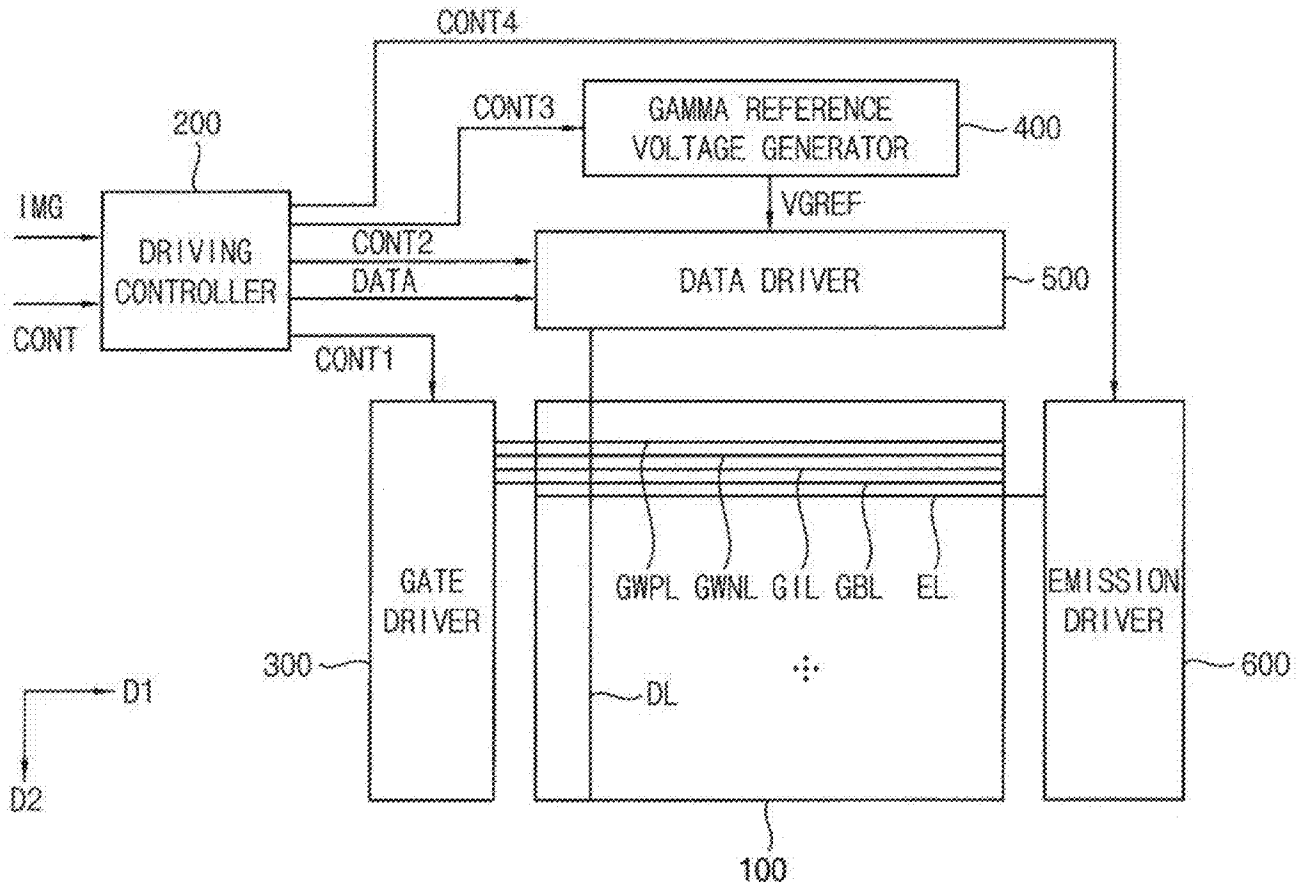
FIG. 1 is a block diagram illustrating a display apparatus according to an exemplary embodiment of the present invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display apparatus according to an exemplary embodiment of the present invention.

Referring to FIG. 1, the display apparatus includes a display panel 100 and a display panel driver. The display panel driver includes a driving controller 200, a gate driver 300, a gamma reference voltage generator 400, a data driver 500, and an emission driver 600.

The display panel 100 has a display region on which an image is displayed and a peripheral region adjacent to the display region.

The display panel 100 includes a plurality of gate lines GWPL, GWNL, GIL, and GBL, a plurality of data lines DL, a plurality of emission lines EL, and a plurality of pixels electrically connected to the gate lines GWPL, GWNL, GIL and GBL, the data lines DL and the emission lines EL. The gate lines GWPL, GWNL, GIL and GBL may extend in a first direction D1, the data lines DL may extend in a second direction D2 crossing the first direction D1 and the emission lines EL may extend in the first direction D1.

The driving controller 200 receives input image data IMG and an input control signal CONT from an external apparatus (not shown). For example, the input image data IMG may include red image data, green image data, and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT 1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWPL, GWNL, GIL, and GBL in response to the first control signal CONT1 received from the driving controller 200. The gate driver 300 may sequentially output the gate signals to the gate lines GWPL, GWNL, GIL, and GBL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200 or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into analog-type data voltages using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

Figure 2:
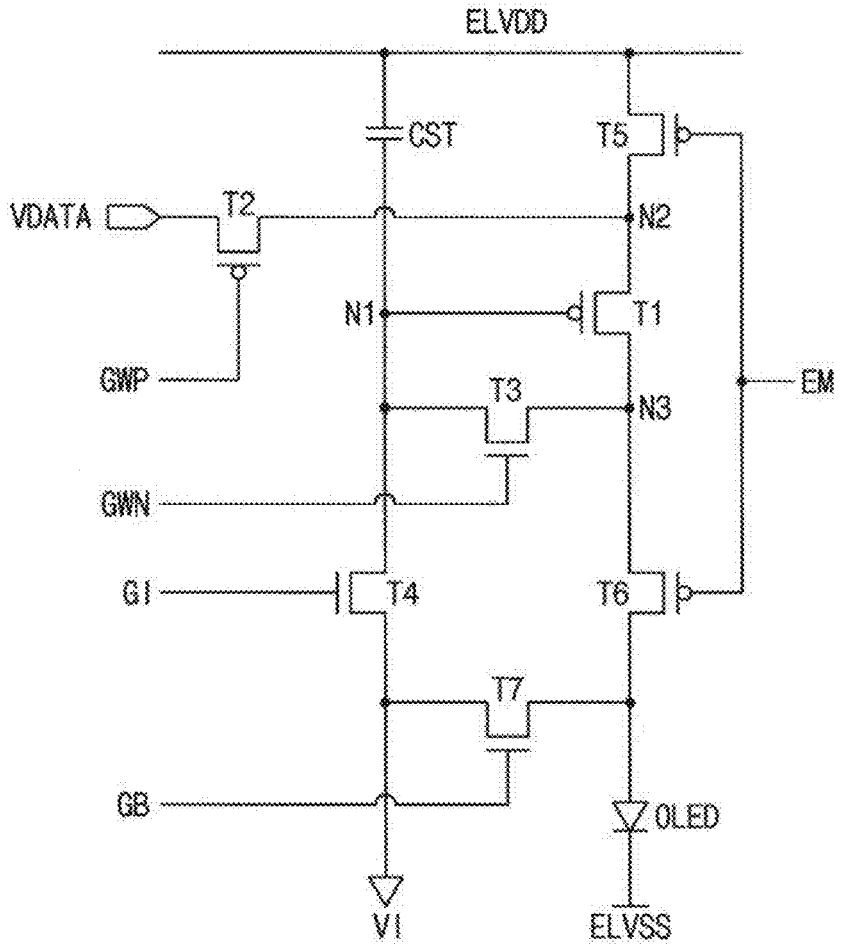
FIG. 2 is a circuit diagram illustrating a pixel of a display panel of FIG. 1.
Figure 3:
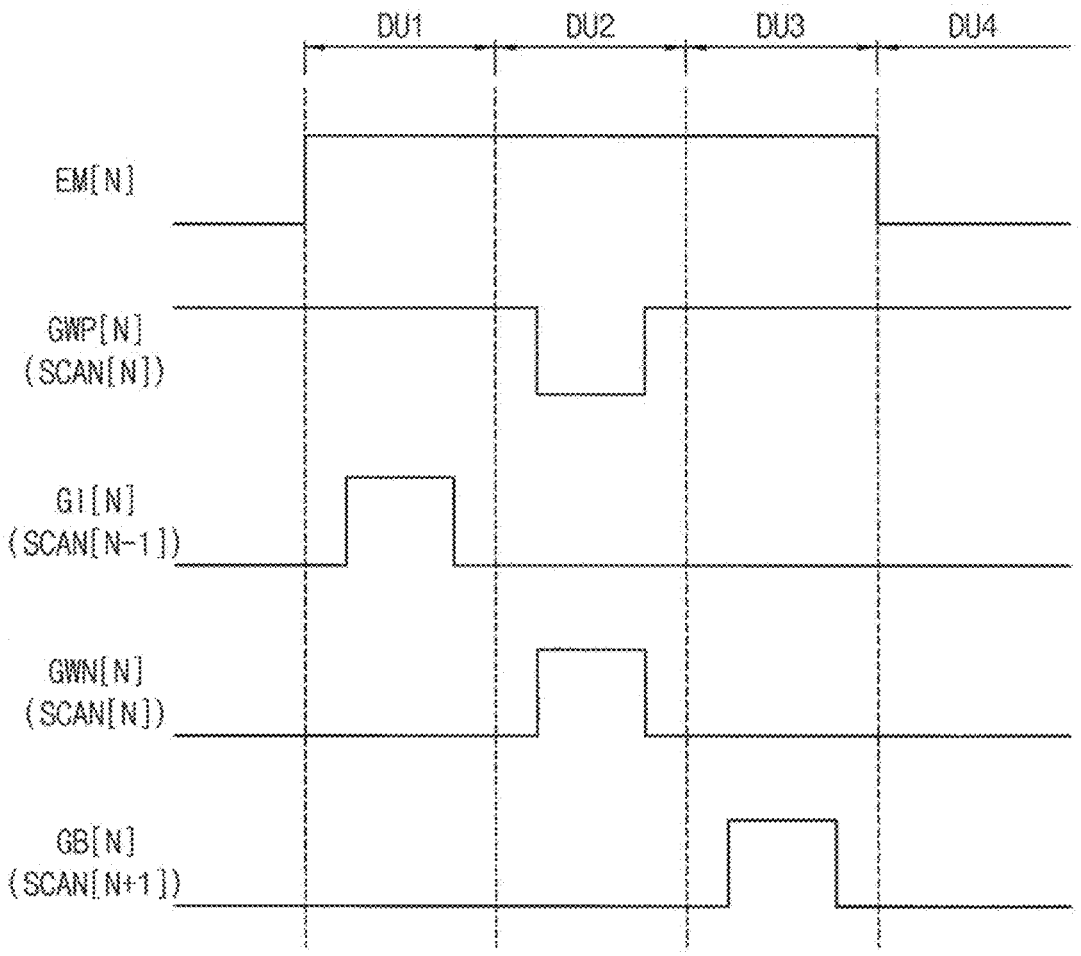
FIG. 3 is a timing diagram illustrating input signals applied to the pixel of FIG. 2.

FIG. 2 is a circuit diagram illustrating a pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In the present exemplary embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

At least one of the pixels may include first to seventh pixel switching elements T1 to T7, a storage capacitor CST, and the organic light emitting element OLED.

The first pixel switching element T1 includes a control electrode connected to a first node N1, an input electrode connected to a second node N2, and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode, and the output electrode of the first pixel switching element T1 may be a drain electrode.

The second pixel switching element T2 includes a control electrode to which the first data write gate signal GWP is applied, an input electrode to which the data voltage VDATA is applied, and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3 includes a control electrode to which the second data write gate signal GWN is applied, an input electrode connected to the first node N1, and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode, and the output electrode of the third pixel switching element T3 may be a drain electrode.

The fourth pixel switching element T4 includes a control electrode to which the data initialization gate signal GI is applied, an input electrode to which an initialization voltage VI is applied, and an output electrode connected to the first node N1.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode, and the output electrode of the fourth pixel switching element T4 may be a drain electrode.

The fifth pixel switching element T5 includes a control electrode to which the emission signal EM is applied, an input electrode to which a high power voltage ELVDD is applied, and an output electrode connected to the second node N2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode, and the output electrode of the fifth pixel switching element T5 may be a drain electrode.

The sixth pixel switching element T6 includes a control electrode to which the emission signal EM is applied, an input electrode connected to the third node N3, and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode, and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied, and an output electrode connected to the anode electrode of the organic light emitting element OLED.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode, and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode connected to the output electrode of the sixth pixel switching element T6 and a cathode electrode to which a low power voltage ELVSS is applied.

In FIG. 3, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration DU3, the anode electrode of the organic light emitting element OLED is initialized in response to the organic light emitting element initialization gate signal GB. During a fourth duration DU4, the organic light emitting element OLED emit the light in response to the emission signal EM so that the display panel 100 displays the image.

Although an "emission off" duration of the emission signal EM corresponds to first to third durations DU1, DU2 and DU3 in the present exemplary embodiment, the inventive concept is not limited thereto. The "emission off" duration of the emission signal EM may be set to include the data writing duration DU2. The "emission off" duration of the emission signal EM may be longer than a sum of the first to third durations DU1, DU2 and DU3.

During the first duration DU1, the data initialization gate signal GI may have an active level. For example, the active level of the data initialization gate signal GI may be a high level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N−1] of a previous stage.

During the second duration DU2, the first data write gate signal GWP and the second data write gate signal GWN may have an active level. For example, the active level of the first data write gate signal GWP may be a low level and the active level of the second data write gate signal GWN may be a high level. When the first data write gate signal GWP and the second data writhe gate signal GWN have the active level, the second pixel switching element T2 and the third pixel switching element T3 are turned on. In addition, the first pixel switching element T1 is turned on in response to the initialization voltage VI. The first data write gate signal GWP[N] of the present stage may be generated based on a scan signal SCAN[N] of the present stage. The second data write gate signal GWN[N] of the present stage may be generated based on the scan signal SCAN[N] of the present stage.

A voltage which is subtraction an absolute value |VTH| of the threshold voltage of the first pixel switching element T1 from the data voltage VDATA may be charged at the first node N1 along a path generated by the first to third pixel switching elements T1, T2 and T3.

During the third duration DU3, the organic light emitting element initialization signal GB may have an active level. For example, the active level of the organic light emitting element initialization signal GB may be a high level. When the organic light emitting element initialization signal GB has the active level, the seventh pixel switching element T7 is turned on so that the initialization voltage VI may be applied to the anode electrode of the organic light emitting element OLED. The organic light emitting element initialization signal GB[N] of the present stage may be generated based on a scan signal SCAN[N+1] of a next stage.

During the fourth duration DU4, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1, and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as following Equation 1.

$$ISD = \frac{1}{2}\mu\ Cox\frac{W}{L}(VSG - |VTH|)^2 \quad \text{[Equation 1]}$$

In Equation 1, μ is a mobility of the first pixel switching element T1. $C_{ox}$ is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG = VDATA - |VTH| \quad \text{[Equation 2]}$$

When the organic light emitting element OLED emits the light during the fourth duration DU4, the driving voltage VOV and the driving current ISD may be represented as following Equations 3 and 4. In Equation 3, VS is a voltage of the second node N2.

$$\begin{aligned} VOV &= VS - VG - |VTH| = \\ &ELVDD - (VDATA - |VTH|) - |VTH| = \\ &ELVDD - VDATA \end{aligned} \quad \text{[Equation 3]}$$

$$ISD = \frac{1}{2}\mu\ Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting element OLED emits the light during the fourth duration DU4.

In the present exemplary embodiment, when the image displayed on the display panel 100 is a static image or the display panel is operated in "always on" mode, a driving frequency of the display panel 100 may be decreased to reduce power consumption. When all of the switching elements of the pixel of the display panel 100 are polysilicon thin film transistor, a flicker may be generated due to a leakage current of the pixel switching element in the low frequency driving mode. Thus, some of the pixel switching elements may be designed using the oxide thin film transistors. In the present exemplary embodiment, the third pixel switching element T3, the fourth pixel switching element T4, and the seventh pixel switching element T7 may be the oxide thin film transistors. The first pixel switching element T1, the second pixel switching element T2, the fifth pixel switching element T5, and the sixth pixel switching element T6 may be the polysilicon thin film transistors.

Figure 4:
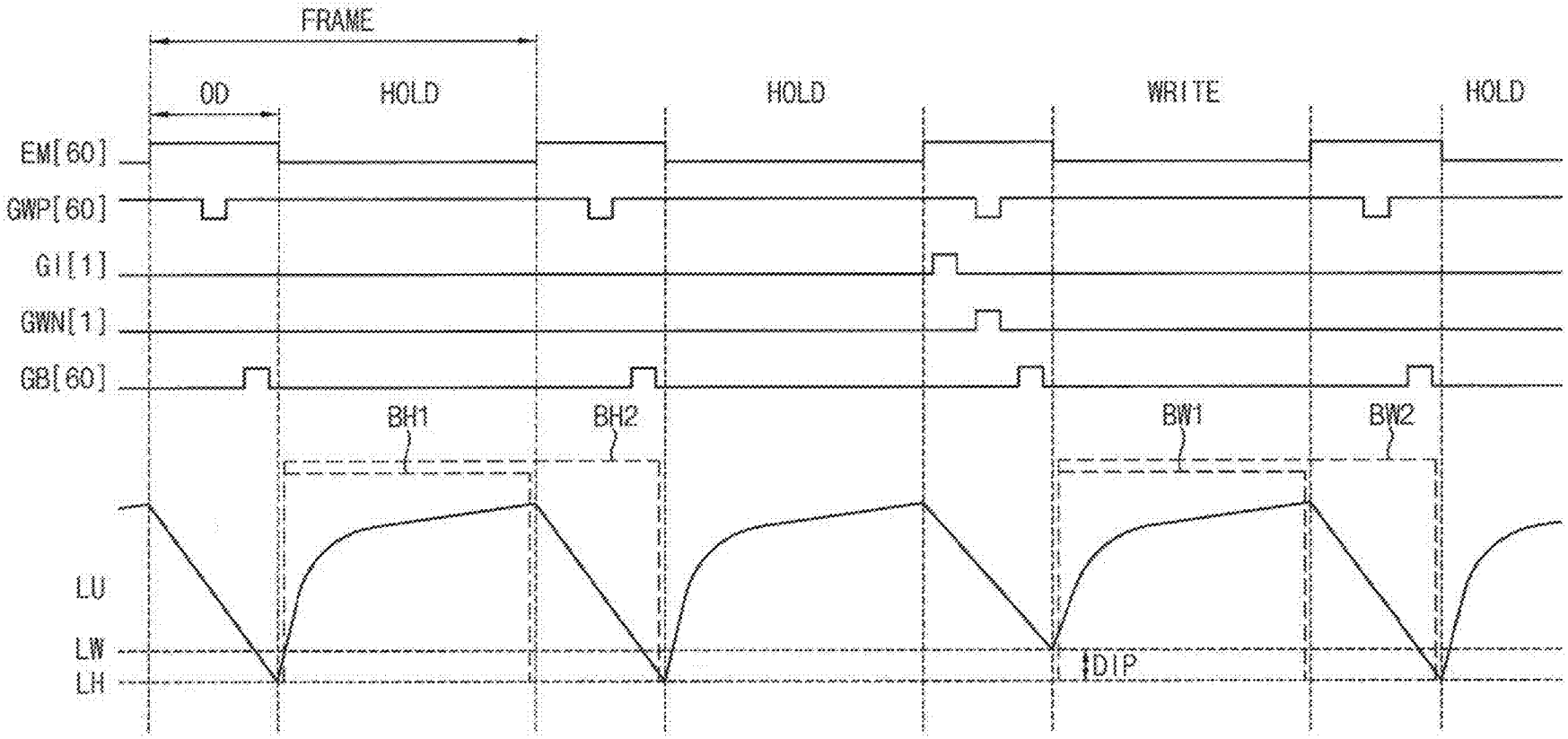
FIG. 4 is a timing diagram illustrating input signals applied to the pixels of the display panel of FIG. 1 in a low frequency driving mode and a luminance of an image displayed on the display panel of FIG. 1.

FIG. 4 is a timing diagram illustrating input signals applied to the pixels of the display panel 100 of FIG. 1 in a low frequency driving mode and a luminance of an image displayed on the display panel 100 of FIG. 1.

Referring to FIGS. 1 to 4, the display panel 100 may be driven in a normal driving mode in which the display panel 100 is driven in a normal driving frequency and in a low frequency driving mode in which the display panel 100 is driven in a frequency less than the normal driving frequency.

For example, when the input image data represent a video image, the display panel 100 may be driven in the normal driving mode. For example, when the input image data represent a static image, the display panel may be driven in the low frequency driving mode. For example, when the display apparatus is operated in the always on mode, the display panel may be driven in the low frequency driving mode.

The driving controller 200 may determine both the driving frequency of the switching element of the first type and the driving frequency of the switching element of the second type to be a first driving frequency in the normal driving mode.

The display panel 100 may be driven in a unit of frame. The display panel 100 may be refreshed in every frame in the normal driving mode. Thus, the normal driving mode includes only writing frames in which the data is written in the pixel.

The driving controller 200 may determine the driving frequency of the switching element of the first type to be the first driving frequency and the driving frequency of the switching element of the second type to be a second driving frequency less than the first driving frequency in the low frequency driving mode.

The display panel 100 may be refreshed in the frequency of the low frequency driving mode in the low frequency driving mode. Thus, the low frequency driving mode includes the writing frames in which the data is written in the pixel and holding frames in which the written data is maintained without writing the data in the pixel.

For example, when the frequency of the normal driving mode is 60 Hz and the frequency of the low frequency driving mode is 1 Hz, the low frequency driving mode includes one writing frame and fifty nine holding frames in a second. Herein, a length of the writing frame may be same as a length of the holding frame. For example, when the frequency of the normal driving mode is 60 Hz and the frequency of the low frequency driving mode is 1 Hz, fifty nine continuous holding frames are disposed between two adjacent writing frames.

For example, when the frequency of the normal driving mode is 60 Hz and the frequency of the low frequency driving mode is 10 Hz, the low frequency driving mode includes ten writing frame and fifty holding frames in a second. Herein, the length of the writing frame may be same as the length of the holding frame. For example, when the frequency of the normal driving mode is 60 Hz and the frequency of the low frequency driving mode is 10 Hz, five continuous holding frames are disposed between two adjacent writing frames.

In the present exemplary embodiment, the second data writing gate signal GWN and the data initialization gate signal GI may have the second driving frequency in the low frequency driving mode. The second driving frequency may be the frequency of the low frequency driving mode. In contrast, the first data writing gate signal GWP, the emission signal EM, and the organic light emitting element initialization gate signal GB may have a first driving frequency greater than the second driving frequency. The first driving frequency may be the normal frequency of the normal driving mode. In FIG. 4, the second driving frequency is 1 Hz and the first driving frequency is 60 Hz.

FIG. 4 illustrates the holding frames and the writing frame disposed between the holding frames and luminance profile LU of the display panel 100 in the holding frames and the writing frame.

The frame may include an "emission off" duration OD when the emission signal EM has the inactive level and an "emission on" duration when the emission signal EM has the active level.

The luminance of the display panel 100 decreases in the "emission off" duration OD and increases to represent a target luminance level in the "emission on" duration.

In FIG. 4, the length of the "emission off" duration OD of the holding frame may be substantially the same as the length of the "emission off" duration OD of the writing frame in the low frequency driving mode. In this case, a lowest level LH of the luminance in the "emission off" duration OD of the holding frame may be different from a lowest level LW of the luminance in the "emission off" duration OD of the writing frame. In the low frequency driving mode, the difference between the lowest level LH of the luminance in the "emission off" duration OD of the holding frame and the lowest level LW of the luminance in the "emission off" duration OD of the writing frame may be generated due to physical characteristics of the pixel switching elements and the driving characteristics of the display apparatus.

For example, the lowest level LH of the luminance in the "emission off" duration OD of the holding frame may be less than the lowest level LW of the luminance in the "emission off" duration OD of the writing frame. The difference DIP between the lowest level LH of the luminance in the "emission off" duration OD of the holding frame and the lowest level LW of the luminance in the "emission off" duration OD of the writing frame may generate the flicker to a user.

Figure 5:
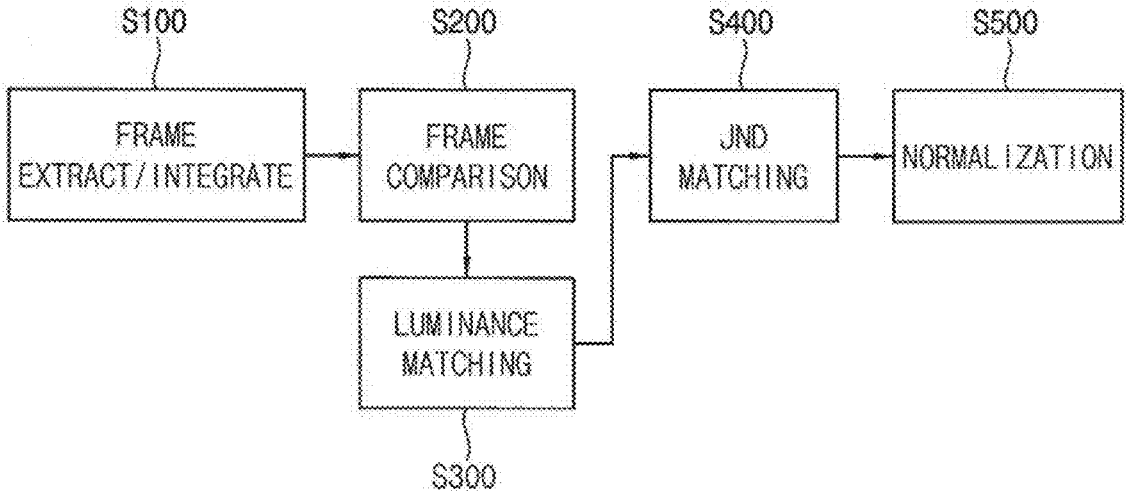
FIG. 5 is a flowchart diagram illustrating a method of determining a second driving frequency in the low frequency driving mode.
Figure 6:
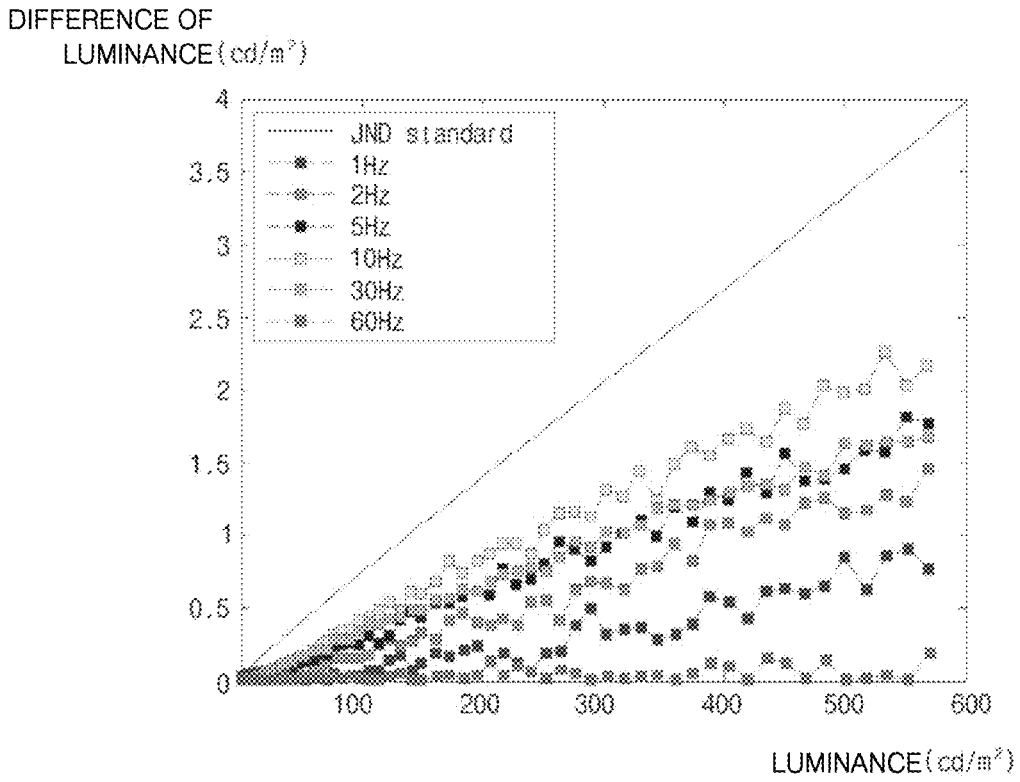
FIG. 6 is a graph illustrating a difference between a luminance of a writing frame and a luminance of a holding frame according to a luminance of the input image data in candidate driving frequencies.
Figure 7:
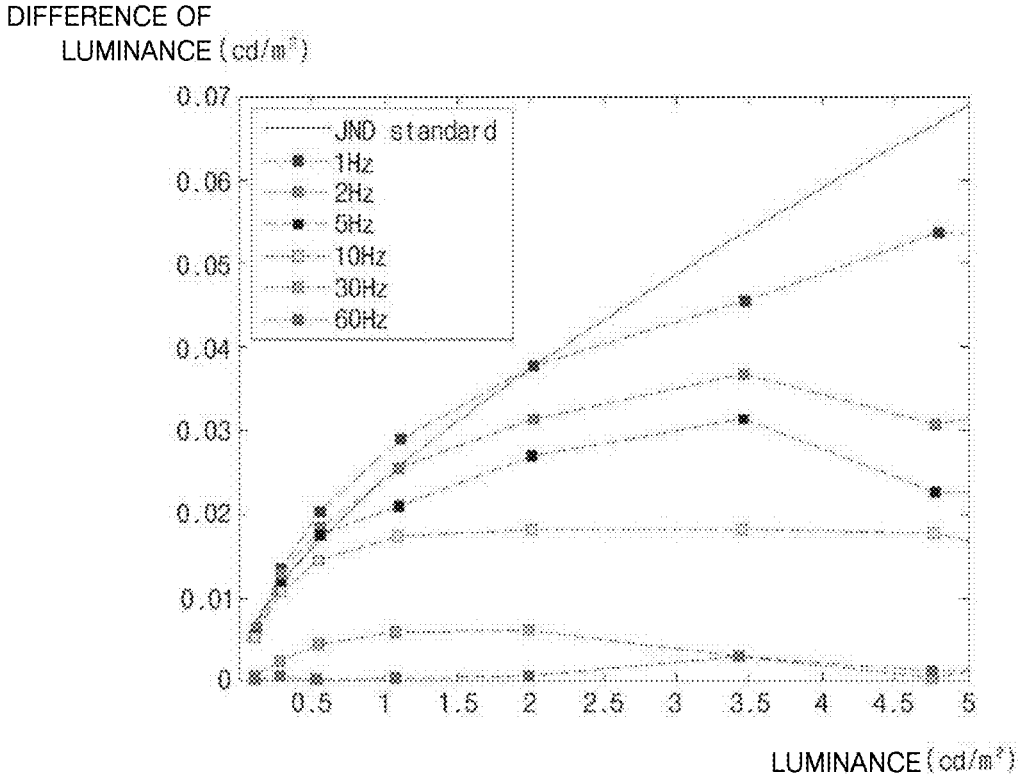
FIG. 7 is a graph illustrating a difference between the luminance of the writing frame and the luminance of the holding frame in a low luminance area of FIG. 6.

FIG. 5 is a flowchart diagram illustrating a method of determining a second driving frequency in the low frequency driving mode. FIG. 6 is a graph illustrating a difference between a luminance of a writing frame and a luminance of a holding frame according to a luminance of the input image data in candidate driving frequencies. FIG. 7 is a graph illustrating a difference between the luminance of the writing frame and the luminance of the holding frame in a low luminance area of FIG. 6.

Referring to FIGS. 1 to 7, the driving controller 200 may determine the second driving frequency based on the difference of the luminance of the writing frame in which the data is written in the pixel and the luminance of the holding frame in which the written data is maintained without writing the data in the pixel.

The driving controller 200 may extract the luminance profile of the holding frame and the luminance profile of the writing frame. The driving controller 200 may accumulate (or integrate) the luminance profile of the holding frame and the luminance profile of the writing frame (step S100).

The luminance profile of the holding frame and the luminance profile of the writing frame may be accumulated with respect to regions of BH1 and BW1 of FIG. 4. Alternatively, the luminance profile of the holding frame and the luminance profile of the writing frame may be accumulated with respect to regions of BH2 and BW2 of FIG. 4.

The minimum value of the luminance profile of the holding frame is LH and the minimum value of the luminance profile of the writing frame is LW greater than LH so that the accumulated luminance profile of the writing frame may be greater than the accumulated luminance profile of the holding frame.

The driving controller 200 may determine the difference of the luminance of the writing frame and the luminance of the holding frame according to the grayscale value (or the luminance) of the input image in candidate driving frequencies (e.g. 1 Hz, 2 Hz, 5 Hz, 10 Hz, 30 Hz and 60 Hz) (step S200).

The driving controller 200 may determine the difference of the luminance of the writing frame and the luminance of the holding frame according to the grayscale value of the input image in the driving frequency of 1 Hz. The driving controller 200 may determine the difference of the luminance of the writing frame and the luminance of the holding frame according to the grayscale value of the input image in the driving frequency of 5 Hz. The driving controller 200 may determine the difference of the luminance of the writing frame and the luminance of the holding frame according to the grayscale value of the input image in the driving frequency of 10 Hz. The driving controller 200 may determine the difference of the luminance of the writing frame and the luminance of the holding frame according to the grayscale value of the input image in the driving frequency of 30 Hz. The driving controller 200 may determine the difference of the luminance of the writing frame and the luminance of the holding frame according to the grayscale value of the input image in the driving frequency of 60 Hz. When the difference of the luminance of the writing frame and the luminance of the holding frame is great, the flicker may be shown to a user so that the difference of the luminance of the writing frame and the luminance of the holding frame may be a flicker index.

If the luminance profile is extracted and accumulated not in a luminance domain in the step S100, the extracted and accumulated luminance profile may be matched to those of a luminance domain (step S300).

The driving controller 200 may compare the difference of the luminance of the writing frame and the luminance of the holding frame to a "just noticeable difference" (JND) (step S400).

The driving controller 200 may determine the minimum driving frequency in a condition that the difference of the luminance of the writing frame and the luminance of the holding frame does not exceed the "just noticeable difference" as the second driving frequency among the candidate driving frequencies. When the difference of the luminance of the writing frame and the luminance of the holding frame is equal to or less than the "just noticeable difference", the flicker may not be noticeable to a user. In contrast, when the difference of the luminance of the writing frame and the luminance of the holding frame is greater than the "just noticeable difference", the flicker may be noticeable to the user.

A standard value (JND standard) of the "just noticeable difference" is illustrated in FIGS. 6 and 7. The standard value of the "just noticeable difference" is set for an ordinary person. The "just noticeable difference" may be varied according to the user so that the "just noticeable difference" may be adjusted according to the user. For example, the standard value of the "just noticeable difference" may be JND 1.0. When the user is sensitive to the flicker, the "just noticeable difference" may be set to a level (e.g. JND 0.8) lower than the standard value of the "just noticeable difference" (JND 1.0). When the user is not sensitive to the flicker, the "just noticeable difference" may be set to a level higher than the standard value of the "just noticeable difference" (JND 1.0).

In FIG. 6, a curve of difference of luminance may partially exceed the standard value of the "just noticeable difference" in a low luminance area. However, the curve of difference of luminance does not exceed the standard value of the "just noticeable difference" except for the low luminance area.

FIG. 7 represents the low luminance area where the curve of difference of luminance partially exceeds the standard value of the "just noticeable difference".

For example, the curve of difference of luminance for the driving frequency of 1 Hz exceeds the standard value of the "just noticeable difference" in a luminance of 0.5 cd/m$^2$, the curve of difference of luminance for the driving frequency of 1 Hz exceeds the standard value of the "just noticeable difference" in a luminance of 1 cd/m$^2$ and the curve of difference of luminance for the driving frequency of 1 Hz coincides with the standard value of the "just noticeable difference" in a luminance of 2 cd/m$^2$.

For example, the curve of difference of luminance for the driving frequency of 2 Hz exceeds the standard value of the "just noticeable difference" in a luminance of 0.5 cd/m$^2$ and the curve of difference of luminance for the driving frequency of 2 Hz coincides with the standard value of the "just noticeable difference" in a luminance of 1 cd/m$^2$.

For example, the curve of difference of luminance for the driving frequency of 5 Hz coincides with the standard value of the "just noticeable difference" in a luminance of 0.5 cd/m$^2$.

When the minimum driving frequency in a condition that the difference of the luminance of the writing frame and the luminance of the holding frame does not exceed the "just noticeable difference" is determined as the second driving frequency among the candidate driving frequencies, the power consumption of the display apparatus may be minimized.

When the second driving frequency is determined by the standard value of the "just noticeable difference", in the luminance of 0.5 cd/m$^2$, the curve of difference of luminance for the driving frequency of 1 Hz and the curve of difference of luminance for the driving frequency of 2 Hz exceed the standard value of the "just noticeable difference" so that the second driving frequency may be determined to 5 Hz having the curve of difference of luminance coinciding with the standard value of the "just noticeable difference". When the second driving frequency is determined by the standard value of the "just noticeable difference", in the luminance of 1 cd/m$^2$, the curve of difference of luminance for the driving frequency of 1 Hz exceeds the standard value of the "just noticeable difference" so that the second driving frequency may be determined to 2 Hz having the curve of difference of luminance coinciding with the standard value of the "just noticeable difference". When the second driving frequency determined by the standard value of the "just noticeable difference", in the luminance of 2 cd/m$^2$, the curve of difference of luminance for the driving frequency of 1 Hz does not exceed the standard value of the "just noticeable difference" so that the second driving frequency may be determined to 1 Hz.

When the second driving frequency is determined by the above method, the display apparatus may be driven in the minimum driving frequency in which the flicker is not shown to a user.

Figure 8:
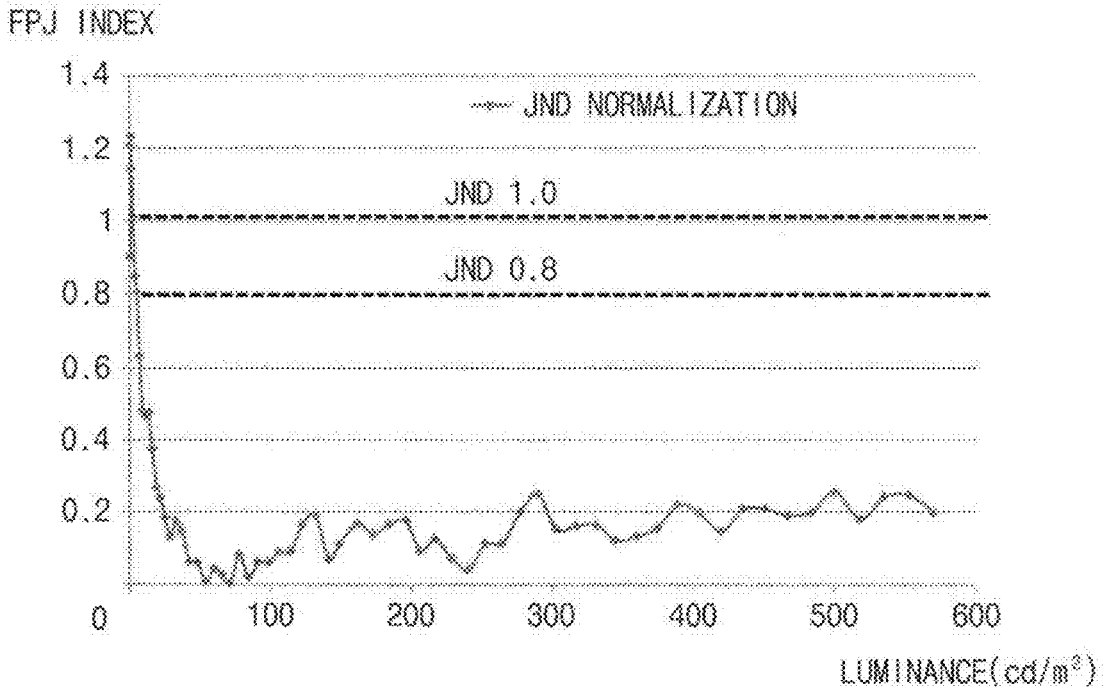
FIG. 8 is a graph illustrating flicker indices according to the luminance of the input image data which is normalized by a "just noticeable difference" (JND).
Figure 9:
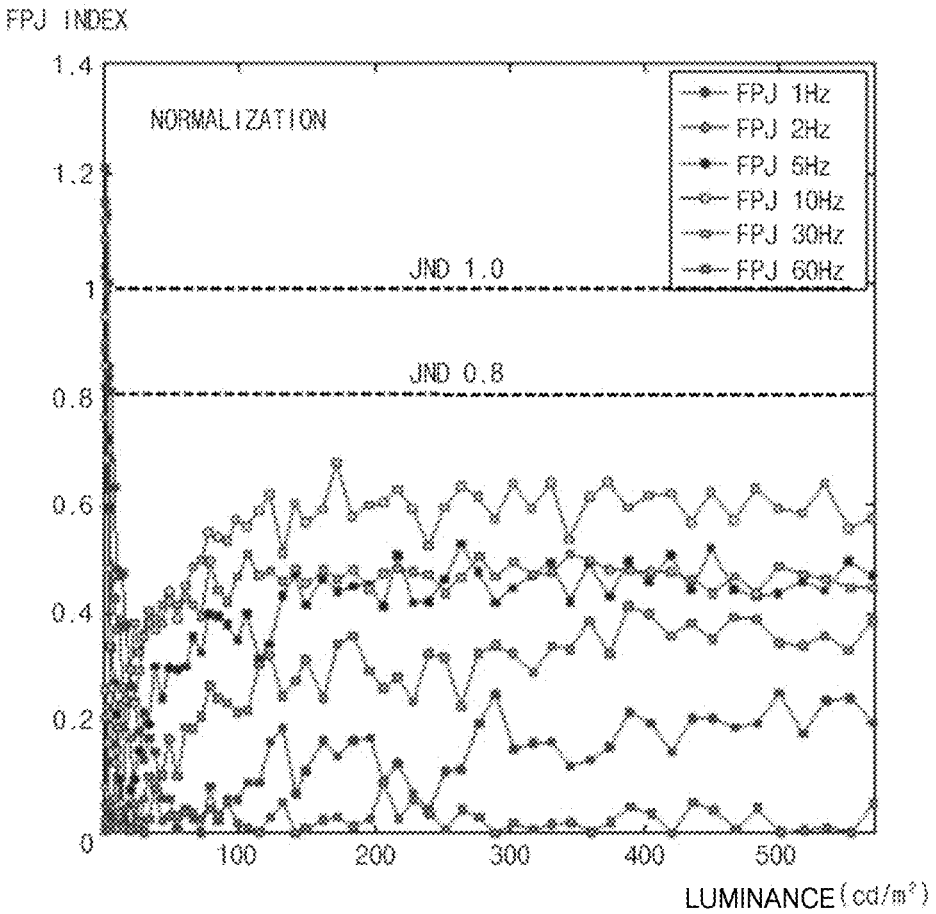
FIG. 9 is a graph illustrating the flicker indices according to the luminance of the input image data which is normalized by the JND in the candidate driving frequencies.
Figure 10:
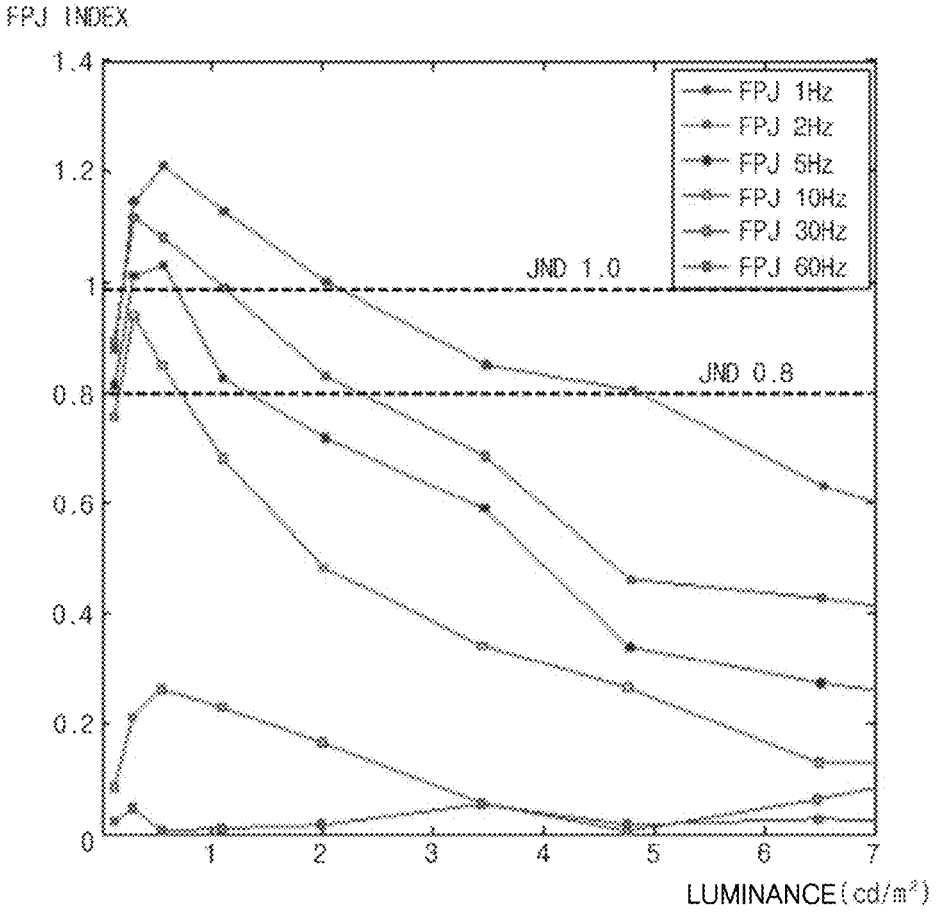
FIG. 10 is a graph illustrating the flicker indices in the low luminance area of FIG. 9.

FIG. 8 is a graph illustrating flicker indices according to the luminance of the input image data which is normalized by a "just noticeable difference" (JND). FIG. 9 is a graph illustrating the flicker indices according to the luminance of the input image data which is normalized by the JND in the candidate driving frequencies. FIG. 10 is a graph illustrating the flicker indices in the low luminance area of FIG. 9.

Referring to FIGS. 1 to 10, the driving controller 200 may normalize the difference of the luminance of the writing frame and the luminance of the holding frame using the "just noticeable difference" to effectively compare the difference of the luminance of the writing frame and the luminance of the holding frame to the "just noticeable difference" (step S500).

The driving controller 200 may divide the difference of the luminance of the writing frame and the luminance of the holding frame by the "just noticeable difference" so that the flicker may be quantified. The difference of the luminance which is normalized using the "just noticeable difference" may be referred to "JND normalized flicker perceptual index". The "JND normalized flicker perceptual index" may be abbreviated as "FPJ".

When the "just noticeable difference" is set to 1.0 by the user, the curve exceeding a line JND 1.0 in FIGS. 8 to 10 means occurrence of flicker in the driving frequency. When the "just noticeable difference" is set to 0.8 by the user, the curve exceeding a line JND 0.8 in FIGS. 8 to 10 means occurrence of flicker in the driving frequency.

FIG. 9 represents the graph of FPJ indices for the candidates driving frequencies which are the curve of difference of luminance of FIG. 6 which is normalized by the "just noticeable difference". FIG. 10 represents the graph of FPJ indices in the low luminance area for the candidates driving frequencies which are the curve of difference of luminance of FIG. 6 which is normalized by the "just noticeable difference". The method of determining the second driving frequency in FIGS. 9 and 10 is same as the explanation referring to FIGS. 6 and 7.

Figure 11:
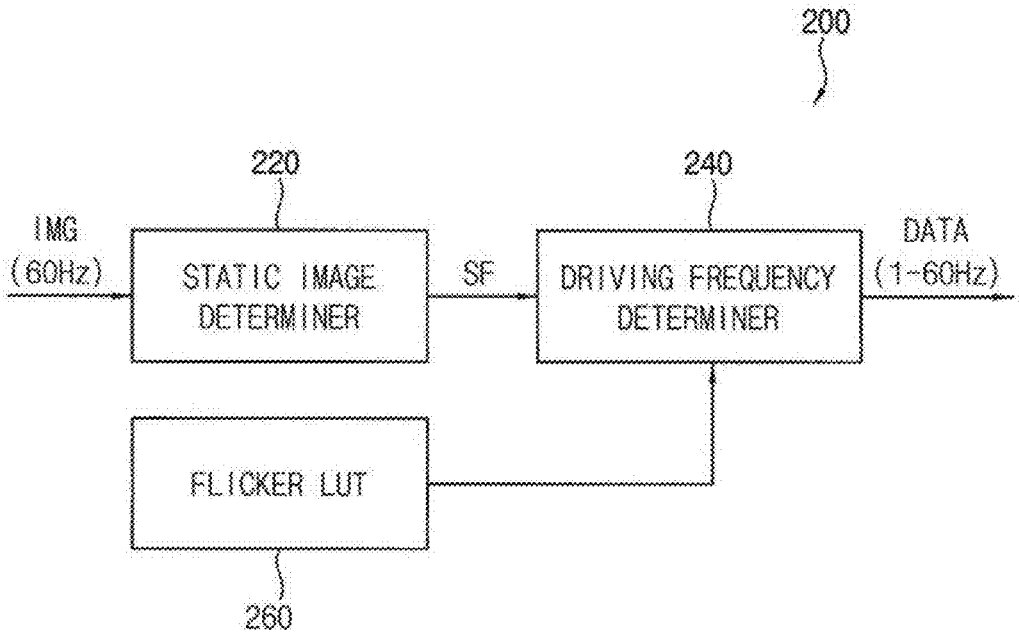
FIG. 11 is a block diagram illustrating a driving controller of FIG. 1.

FIG. 11 is a block diagram illustrating the driving controller 200 of FIG. 1. FIG. 12 is a table illustrating an exemplary flicker lookup table of FIG. 11.

Referring to FIGS. 11 and 12, the driving controller 200 may include a static image determiner 220, a driving frequency determiner 240, and a flicker lookup table 260.

The static image determiner 220 may determine whether the input image data IMG is a static image or a video image. The static image determiner 220 may output a flag SF representing whether the input image data IMG is the static image or the video image to the driving frequency determiner 240. For example, when the input image data IMG is the static image, the static image determiner 220 may output the flag SF of 1 to the driving frequency determiner 240. When the input image data IMG is the video image, the static image determiner 220 may output the flag SF of 0 to the driving frequency determiner 240. When the display panel 100 is operated in always on mode, the static image determiner 220 may output the flag SF of 1 to the driving frequency determiner 240.

When the flag SF is 1, the driving frequency determiner 240 may drive the switching elements having the first type in a normal driving frequency and may drive the switching elements having the second type in a low driving frequency.

When the flag SF is 0, the driving frequency determiner 240 may drive the switching elements having the first type and the switching elements having the second type in the normal driving frequency.

The driving frequency determiner 240 may refer the flicker lookup table 260 to determine the low driving frequency. As explained above, the flicker lookup table 260 may store the minimum driving frequency in a condition that the difference of the luminance of the writing frame and the luminance of the holding frame does not exceed the "just noticeable difference" as the second driving frequency for the grayscale value of the input image data.

In FIG. 12, the flicker lookup table may have a value of 0 for the grayscale values of 0, 1 and 2. Herein the value of 0 of the flicker lookup table may represent the second driving frequency of 1 Hz. In FIG. 12, the flicker lookup table may have a value of 1 for the grayscale values of 15, 16 and 17. Herein the value of 1 of the flicker lookup table may represent the second driving frequency of 30 Hz. In FIG. 12, the flicker lookup table may have a value of 2 for the grayscale values of 18 to 22. Herein the value of 2 of the flicker lookup table may represent the second driving frequency of 10 Hz.

According to the present exemplary embodiment, an optimal driving frequency which does not generate the flicker may be determined using the difference of the luminance of the writing frame and the luminance of the holding frame and the "just noticeable difference" for the grayscale values of the input image data. In addition, the "just noticeable difference" may be set for the user. Thus, the power consumption of the display apparatus may be minimized, and the flicker may be prevented so that the display quality of the display panel 100 may be enhanced.

Figures 13, 14:
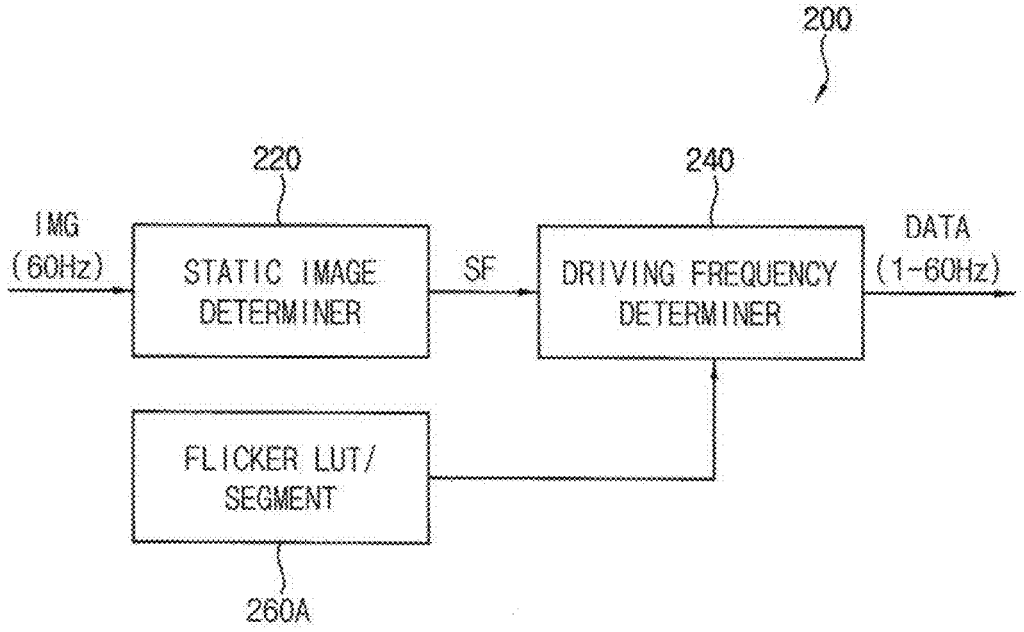
FIG. 13 is a conceptual diagram illustrating a display panel of a display apparatus according to an exemplary embodiment of the present invention.
FIG. 14 is a block diagram illustrating a driving controller of the display apparatus of FIG. 13.

FIG. 13 is a conceptual diagram illustrating a display panel of a display apparatus according to an exemplary embodiment of the present invention. FIG. 14 is a block diagram illustrating a driving controller of the display apparatus of FIG. 13.

The display apparatus and the method of driving the display panel according to the present exemplary embodiment is substantially the same as the display apparatus and the method of driving the display panel of the previous exemplary embodiment explained referring to FIGS. 1 to 12, except that the display panel is divided into a plurality of segments. Thus, the same reference numerals will be used to refer to the same or like parts as those described in the previous exemplary embodiment of FIGS. 1 to 12, and any repetitive explanation concerning the above elements will be omitted.

Referring to FIGS. 1 to 10 and 12 to 14, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA, and the emission signal EM and the organic light emitting element OLED of the pixel emits light corresponding to the level of the data voltage VDATA to display the image.

The display panel 100 may include a plurality of segments SEG11 to SEG55. Although the display panel 100 includes the segments in a five by five matrix in the present exemplary embodiment, the inventive concept is not limited thereto.

When the flicker index is determined for a unit of the pixel and only one pixel has a high flicker index, the entire display panel may be driven in a high driving frequency to prevent the flicker in the one pixel. For example, when a flicker of only one pixel is prevented in the driving frequency of 30 Hz and the other pixels do not generate the flicker in the driving frequency of 1 Hz, the display panel 100 may be driven in the driving frequency of 30 Hz and the power consumption of the display apparatus may be higher than necessary.

Thus, when the display panel 100 is divided into the segments and the flicker index is determined for a unit of the segment, the power consumption of the display apparatus may be effectively reduced.

The driving controller 200 may determine the difference of the luminance of the writing frame and the luminance of the holding frame according to the grayscale value (or the luminance) of the input image in candidate driving frequencies in each of the segments.

The driving controller 200 may determine optimal driving frequencies for the segments and may determine the maximum driving frequency among the optimal driving frequencies for the segments as the second driving frequency.

For example, when an optimal driving frequency for a first segment SEG11 is 10 Hz and optimal driving frequencies for the other segments SEG12 to SEG55, except for the first segment SEG11 are 2 Hz, the driving controller 200 may determine the low driving frequency to 10 Hz.

The driving controller 200 may include a static image determiner 220, a driving frequency determiner 240 and a flicker lookup table 260A.

The static image determiner 220 may determine whether the input image data IMG is a static image or a video image. The static image determiner 220 may output a flag SF representing whether the input image data IMG is the static image or the video image to the driving frequency determiner 240.

When the flag SF is 1, the driving frequency determiner 240 may drive the switching elements having the first type in a normal driving frequency and may drive the switching elements having the second type in a low driving frequency.

When the flag SF is 0, the driving frequency determiner 240 may drive the switching elements having the first type and the switching elements having the second type in the normal driving frequency.

The driving frequency determiner 240 may refer the flicker lookup table 260A and segment information to determine the low driving frequency. As explained above, the flicker lookup table 260A may store the minimum driving frequency in a condition that the difference of the luminance of the writing frame and the luminance of the holding frame does not exceed the "just noticeable difference" as the second driving frequency for the grayscale value of the input image data.

According to the present exemplary embodiment, an optimal driving frequency which does not generate the flicker may be determined using the difference of the luminance of the writing frame and the luminance of the holding frame and the "just noticeable difference" for the grayscale values of the input image data. In addition, the "just noticeable difference" may be set for the user. Thus, the power consumption of the display apparatus may be minimized, and the flicker may be prevented so that the display quality of the display panel 100 may be enhanced.

FIG. 15 is a table illustrating an exemplary flicker lookup table of a driving controller of a display apparatus according to an exemplary embodiment of the inventive concept.

The display apparatus and the method of driving the display panel according to the present exemplary embodiment is substantially the same as the display apparatus and the method of driving the display panel of the previous exemplary embodiment explained referring to FIGS. 1 to 12 except for the flicker lookup table. Thus, the same reference numerals will be used to refer to the same or like parts as those described in the previous exemplary embodiment of FIGS. 1 to 12, and any repetitive explanation concerning the above elements will be omitted.

Referring to FIGS. 1 to 11 and 15, the display apparatus includes a display panel 100 and a display panel driver. The display panel driver includes a driving controller 200, a gate driver 300, a gamma reference voltage generator 400, a data driver 500, and an emission driver 600.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA, and the emission signal EM, and the organic light emitting element OLED of the pixel emits light corresponding to the level of the data voltage VDATA to display the image.

The driving controller 200 may determine both the driving frequency of the switching element of the first type and the driving frequency of the switching element of the second type to a first driving frequency in the normal driving mode.

The driving controller 200 may determine the driving frequency of the switching element of the first type to be the first driving frequency and the driving frequency of the switching element of the second type to be a second driving frequency less than the first driving frequency in the low frequency driving mode.

The driving controller 200 may determine the minimum driving frequency in a condition that the difference of the luminance of the writing frame and the luminance of the holding frame does not exceed the "just noticeable difference" as the second driving frequency among the candidate driving frequencies.

The driving controller 200 may include a static image determiner 220, a driving frequency determiner 240 and a flicker lookup table 260.

The static image determiner 220 may determine whether the input image data IMG is a static image or a video image. The static image determiner 220 may output a flag SF representing whether the input image data IMG is the static image or the video image to the driving frequency determiner 240.

When the flag SF is 1, the driving frequency determiner 240 may drive the switching elements having the first type in a normal driving frequency and may drive the switching elements having the second type in a low driving frequency.

When the flag SF is 0, the driving frequency determiner 240 may drive the switching elements having the first type and the switching elements having the second type in the normal driving frequency.

The driving frequency determiner 240 may refer the flicker lookup table 260 to determine the low driving frequency. As explained above, the flicker lookup table 260 may store the minimum driving frequency in a condition that the difference of the luminance of the writing frame and the luminance of the holding frame does not exceed the "just noticeable difference" as the second driving frequency for the grayscale value of the input image data.

In the present exemplary embodiment, the flicker lookup table 260 may map one grayscale group including a plurality of grayscale values to one of the second driving frequencies. In FIG. 15, one grayscale group including three grayscale values may be mapped to one of the second driving frequencies. For example, the flicker lookup table 260 may store one value for the grayscale values 0 to 2 and the flicker lookup table 260 may have the value of 0 for the grayscale values of 0 to 2. For example, the flicker lookup table 260 may store one value for the grayscale values 3 to 5 and the flicker lookup table 260 may have the value of 0 for the grayscale values of 3 to 5. For example, the flicker lookup table 260 may store one value for the grayscale values 15 to 17 and the flicker lookup table 260 may have the value of 1 for the grayscale values of 15 to 17. For example, the flicker lookup table 260 may store one value for the grayscale values 18 to 20 and the flicker lookup table 260 may have the value of 2 for the grayscale values of 18 to 20.

As explained above, the flicker lookup table 260 may store one value for the plurality of the grayscale values so that the storage space of the flicker lookup table 260 may be reduced. Thus, the manufacturing cost of the display apparatus may be reduced.

In an exemplary embodiment, the size of the grayscale group may be varied according to the luminance area. In the low luminance area, the amount of change of the flicker index is relatively high so that the size of the grayscale group may be set to one grayscale value so that the flicker lookup table may store the value for every grayscale value in the low luminance area. In contrast, in the high luminance area, the amount of change of the flicker index is relatively low so that the size of the grayscale group may be set to over ten grayscale values so that the flicker lookup table may store the value for every ten or more grayscale values in the high luminance area.

According to the present exemplary embodiment, an optimal driving frequency which does not generate the flicker may be determined using the difference of the luminance of the writing frame and the luminance of the holding frame and the "just noticeable difference" for the grayscale values of the input image data. In addition, the "just noticeable difference" may be set for the user. Thus, the power consumption of the display apparatus may be minimized, and the flicker may be prevented so that the display quality of the display panel 100 may be enhanced.

Figure 16:
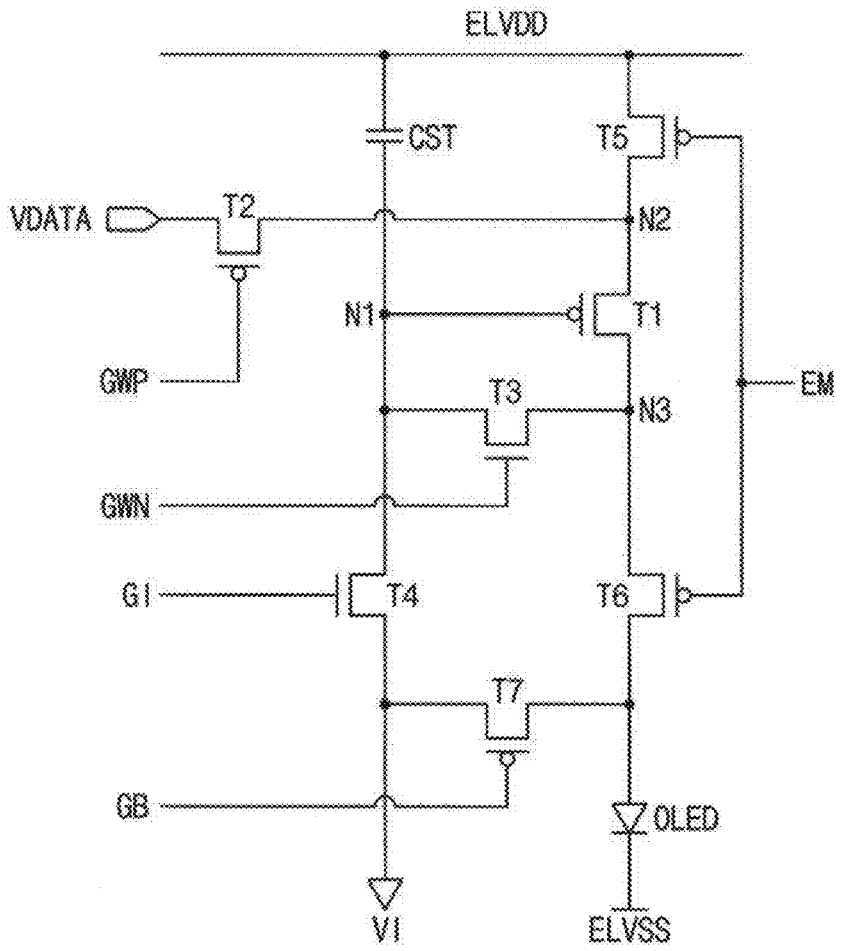
FIG. 16 is a circuit diagram illustrating a pixel of a display panel of a display apparatus according to an exemplary embodiment of the present invention.
Figure 17:
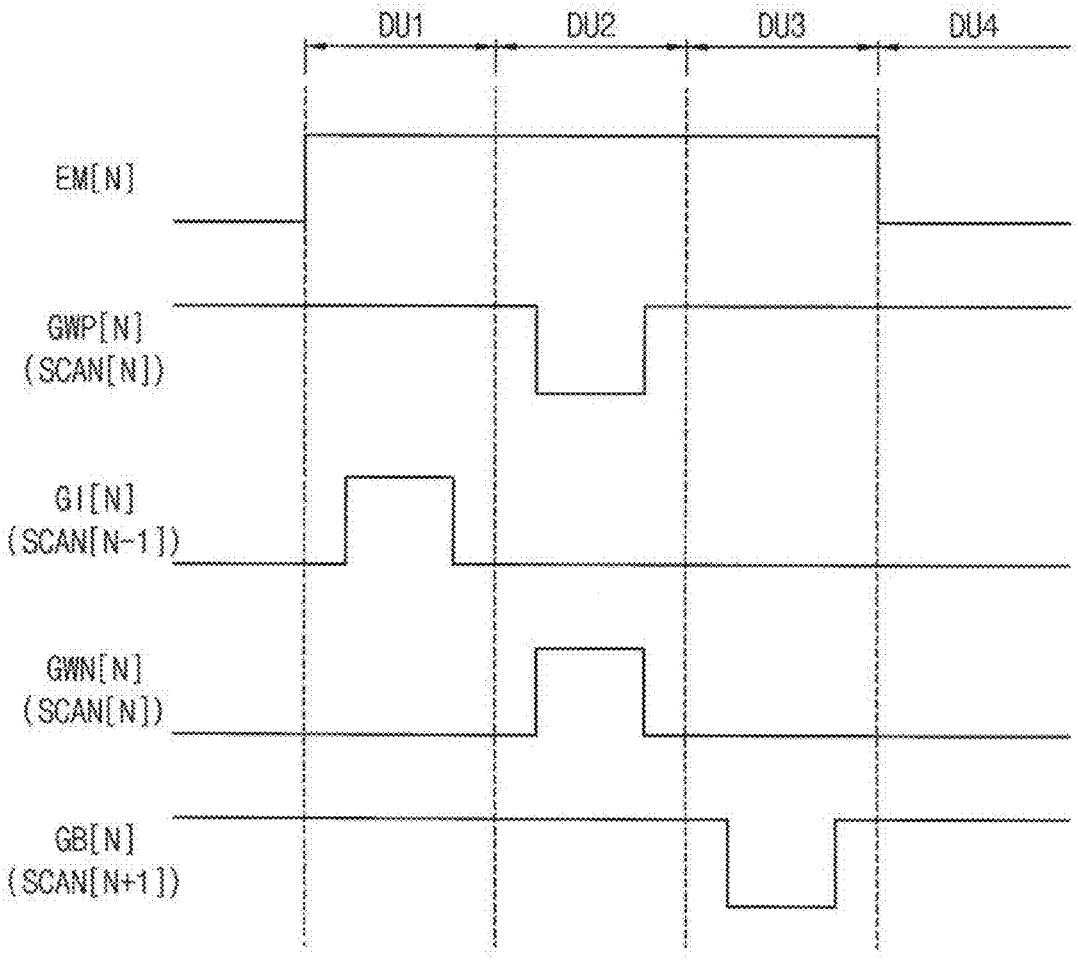
FIG. 17 is a timing diagram illustrating input signals applied to the pixel of FIG. 16.

FIG. 16 is a circuit diagram illustrating a pixel of a display panel of a display apparatus according to an exemplary embodiment of the inventive concept. FIG. 17 is a timing diagram illustrating input signals applied to the pixel of FIG. 16.

The display apparatus and the method of driving the display panel according to the present exemplary embodiment is substantially the same as the display apparatus and the method of driving the display panel of the previous exemplary embodiment explained referring to FIGS. 1 to 12 except for the pixel structure. Thus, the same reference numerals will be used to refer to the same or like parts as those described in the previous exemplary embodiment of FIGS. 1 to 12 and any repetitive explanation concerning the above elements will be omitted.

Referring to FIGS. 1, 4 to 12, 16, and 17, the display apparatus includes a display panel 100 and a display panel driver. The display panel driver includes a driving controller 200, a gate driver 300, a gamma reference voltage generator 400, a data driver 500 and an emission driver 600.

The display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA, and the emission signal EM, and the organic light emitting element OLED of the pixel emits light corresponding to the level of the data voltage VDATA to display the image.

In the present exemplary embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

At least one of the pixels may include first to seventh pixel switching elements T1 to T7, a storage capacitor CST, and the organic light emitting element OLED.

In the present exemplary embodiment, the seventh pixel switching element T7 includes a control electrode to which the organic light emitting element initialization gate signal GB is applied, an input electrode to which the initialization voltage VI is applied, and an output electrode connected to the anode electrode of the organic light emitting element OLED.

For example, the seventh pixel switching element T7 may be the polysilicon thin film transistor. For example, the seventh pixel switching element T7 may be a P-type thin film transistor.

In FIG. 17, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration DU3, the anode electrode of the organic light emitting element OLED is initialized in response to the organic light emitting element initialization gate signal GB. During a fourth duration DU4, the organic light emitting element OLED emit the light in response to the emission signal EM so that the display panel 100 displays the image.

In the present exemplary embodiment, the active level of the organic light emitting element initialization signal GB may be a low level.

In the present exemplary embodiment, some of the pixel switching elements may be designed using the oxide thin film transistors. In the present exemplary embodiment, the third pixel switching element T3 and the fourth pixel switching element T4 may be the oxide thin film transistors. The first pixel switching element T1, the second pixel switching element T2, the fifth pixel switching element T5, the sixth pixel switching element T6, and the seventh pixel switching element T7 may be the polysilicon thin film transistors.

The driving controller 200 may determine both the driving frequency of the switching element of the first type and the driving frequency of the switching element of the second type to be a first driving frequency in the normal driving mode.

The driving controller 200 may determine the driving frequency of the switching element of the first type to be the first driving frequency and the driving frequency of the switching element of the second type to be a second driving frequency less than the first driving frequency in the low frequency driving mode.

The driving controller 200 may determine the minimum driving frequency in a condition that the difference of the luminance of the writing frame and the luminance of the holding frame does not exceed the "just noticeable difference" as the second driving frequency among the candidate driving frequencies.

According to the present exemplary embodiment, an optimal driving frequency which does not generate the flicker may be determined using the difference of the luminance of the writing frame and the luminance of the holding frame and the "just noticeable difference" for the grayscale values of the input image data. In addition, the "just noticeable difference" may be set for the user. Thus, the power consumption of the display apparatus may be minimized, and the flicker may be prevented so that the display quality of the display panel 100 may be enhanced.

According to the inventive concept as explained above, the power consumption of the display apparatus may be reduced and the display quality of the display panel may be enhanced.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display apparatus comprising: a display panel comprising a pixel comprising a switching element of a first type and a switching element of a second type different from the first type; a gate driver configured to output a gate signal to the display panel; a data driver configured to output a data voltage to the display panel; an emission driver configured to output an emission signal to the display panel; and a driving controller configured to determine a driving frequency of a signal input to the switching element of the first type to be a first driving frequency and a driving frequency of a signal input to the switching element of the second type to be a second driving frequency less than the first driving frequency in a low frequency driving mode, wherein: the driving controller is configured to determine the second driving frequency based on a difference of a luminance of a writing frame in which the data voltage is written in the pixel and a luminance of a holding frame in which the written data voltage in the pixel is maintained without writing the data voltage, the driving controller is configured to determine the second driving frequency by determining a difference of the luminance of the writing frame and the luminance of the holding frame according to a grayscale value of an input image in candidate driving frequencies; and the driving controller is configured to determine a minimum driving frequency in a condition that the difference of the luminance of the writing frame and the luminance of the holding frame does not exceed a predetermined difference as the second driving frequency among the candidate driving frequencies.

2. The display apparatus of claim 1, wherein the driving controller is configured to determine the driving frequency of the signal input to the switching element of the first type to be the first driving frequency and the driving frequency of the signal input to the switching element of the second type to be the first driving frequency in a normal driving mode.

3. A display apparatus comprising:

a display panel comprising a pixel comprising a switching element of a first type and a switching element of a second type different from the first type;

a gate driver configured to output a gate signal to the display panel;

a data driver configured to output a data voltage to the display panel;

an emission driver configured to output an emission signal to the display panel; and a driving controller configured to determine a driving frequency of a signal input to the switching element of the first type to be a first driving frequency and a driving frequency of a signal input to the switching element of the second type to be a second driving frequency less than the first driving frequency in a low frequency driving mode, wherein:

the driving controller is configured to determine the second driving frequency based on a difference of a luminance of a writing frame in which the data voltage is written in the pixel and a luminance of a holding frame in which the written data voltage in the pixel is maintained without writing the data voltage;

the driving controller is configured to determine the second driving frequency by determining a difference of the luminance of the writing frame and the luminance of the holding frame according to a grayscale value of an input image in candidate driving frequencies; and the driving controller is configured to extract a luminance profile of the holding frame and a luminance of the writing frame and to accumulate the luminance profile of the holding frame and the luminance of the writing frame to determine the difference of the luminance of the writing frame and the luminance of the holding frame.

4. The display apparatus of claim 1, wherein the predetermined difference is configured to be adjusted by a user.

5. The display apparatus of claim 1, wherein:

the display panel includes a plurality of segments;

the driving controller is configured to determine the difference of the luminance of the writing frame and the luminance of the holding frame according to the grayscale value of the input image in the candidate driving frequencies in each of the segments; and the driving controller is configured to determine optimal driving frequencies for the segments and to determine a maximum driving frequency among the optimal driving frequencies for the segments as the second driving frequency.

6. The display apparatus of claim 1, wherein the driving controller is configured to map a grayscale group including a plurality of grayscale values to the second driving frequency.

7. The display apparatus of claim 1, wherein:

the switching element of the first type is a polysilicon thin film transistor; and the switching element of the second type is an oxide thin film transistor.

8. The display apparatus of claim 7, wherein:

the switching element of the first type is a P-type transistor; and the switching element of the second type is an N-type transistor.

9. The display apparatus of claim 7, wherein the pixel comprises:

a first pixel switching element comprising a control electrode connected to a first node, an input electrode connected to a second node, and an output electrode connected to a third node;

a second pixel switching element comprising a control electrode to which a first data write gate signal is applied, an input electrode to which the data voltage is applied, and an output electrode connected to the second node;

a third pixel switching element comprising a control electrode to which a second data write gate signal is applied, an input electrode connected to the first node, and an output electrode connected to the third node;

a fourth pixel switching element comprising a control electrode to which a data initialization gate signal is applied, an input electrode to which an initialization voltage is applied, and an output electrode connected to the first node;

a fifth pixel switching element comprising a control electrode to which the emission signal is applied, an input electrode to which a high power voltage is applied, and an output electrode connected to the second node;

a sixth pixel switching element comprising a control electrode to which the emission signal is applied, an input electrode connected to the third node, and an output electrode connected to an anode electrode of an organic light emitting element;

a seventh pixel switching element comprising a control electrode to which an organic light emitting element initialization gate signal is applied, an input electrode to which the initialization voltage is applied, and an output electrode connected to the anode electrode of the organic light emitting element;

a storage capacitor comprising a first electrode to which the high power voltage is applied and a second electrode connected to the first node; and the organic light emitting element comprising the anode electrode connected to the output electrode of the sixth switching element and a cathode electrode to which a low power voltage is applied.

10. The display apparatus of claim 9, wherein:

the first pixel switching element, the second pixel switching element, the fifth pixel switching element, and the sixth pixel switching element are the polysilicon thin film transistors; and the third pixel switching element, the fourth pixel switching element, and the seventh pixel switching element are the oxide thin film transistors.

11. The display apparatus of claim 9, wherein:

the first pixel switching element, the second pixel switching element, the fifth pixel switching element, the sixth pixel switching element, and the seventh pixel switching element are the polysilicon thin film transistors; and the third pixel switching element and the fourth pixel switching element are the oxide thin film transistors.

12. A method of driving a display panel, the method comprising: determining a driving frequency of a signal input to a switching element of a first type to be a first driving frequency in a low frequency driving mode; determining a driving frequency of a signal input to a switching element of a second type different from the first type to be a second driving frequency less than the first driving frequency in the low frequency driving mode; outputting a gate signal to the display panel comprising a pixel including the switching element of the first type and the switching element of the second type; outputting a data voltage to the display panel; and outputting an emission signal to the display panel, wherein: the second driving frequency is determined based on a difference of a luminance of a writing frame in which the data voltage is written in the pixel and a luminance of a holding frame in which the written data voltage in the pixel is maintained without writing the data voltage, the determining the driving frequency to be the second driving frequency comprises determining a difference of the luminance of the writing frame and the luminance of the holding frame according to a grayscale value of an input image in candidate driving frequencies; and the determining the driving frequency to be the second driving frequency further comprises determining a minimum driving frequency in a condition that the difference of the luminance of the writing frame and the luminance of the holding frame does not exceed a predetermined difference as the second driving frequency among the candidate driving frequencies.

13. The method of claim 12, further comprising:

determining the driving frequency of the signal input to the switching element of the first type to be the first driving frequency in a normal driving mode; and determining the driving frequency of the signal input to the switching element of the second type to be the first driving frequency in the normal driving mode.

14. A method of driving a display panel, the method comprising:

determining a driving frequency of a signal input to a switching element of a first type to be a first driving frequency in a low frequency driving mode;

determining a driving frequency of a signal input to a switching element of a second type different from the first type to be a second driving frequency less than the first driving frequency in the low frequency driving mode;

outputting a gate signal to the display panel comprising a pixel including the switching element of the first type and the switching element of the second type;

outputting a data voltage to the display panel; and outputting an emission signal to the display panel, wherein:

the second driving frequency is determined based on a difference of a luminance of a writing frame in which the data voltage is written in the pixel and a luminance of a holding frame in which the written data voltage in the pixel is maintained without writing the data voltage;

the determining the driving frequency to be the second driving frequency comprises determining a difference of the luminance of the writing frame and the luminance of the holding frame according to a grayscale value of an input image in candidate driving frequencies; and the determining the driving frequency to be the second driving frequency further comprises:

extracting a luminance profile of the holding frame;

extracting a luminance profile of the writing frame;

accumulating the luminance profile of the holding frame;

accumulation the luminance profile of the writing frame; and determining the difference of the luminance of the writing frame and the luminance of the holding frame.

15. The method of claim 12, wherein the predetermined difference is configured to be adjusted by a user.

16. The method of claim 12, wherein:

the display panel includes a plurality of segments; and the determining the driving frequency to be the second driving frequency further comprises:

determining the difference of the luminance of the writing frame and the luminance of the holding frame according to the grayscale value of the input image in the candidate driving frequencies in each of the segments, determining optimal driving frequencies for the segments; and determining a maximum driving frequency among the optimal driving frequencies for the segments as the second driving frequency.

* * * * *